US007907477B2

(12) United States Patent
Puzia

(10) Patent No.: US 7,907,477 B2
(45) Date of Patent: Mar. 15, 2011

(54) BOTTLE CAP MEDICATION TIMER

(76) Inventor: Scott Puzia, Randolph, NJ (US)

( * ) Notice: Subject to any disclaimer, the term of this patent is extended or adjusted under 35 U.S.C. 154(b) by 0 days.

(21) Appl. No.: 12/039,972

(22) Filed: Feb. 29, 2008

(65) Prior Publication Data

US 2009/0052283 A1 Feb. 26, 2009

Related U.S. Application Data

(60) Provisional application No. 60/892,622, filed on Mar. 2, 2007.

(51) Int. Cl.
*G04B 47/00* (2006.01)
*G04F 8/00* (2006.01)
*B65D 51/00* (2006.01)

(52) U.S. Cl. ..... 368/10; 368/109; 215/230

(58) Field of Classification Search ..... 368/10, 368/107–109, 110, 185, 187, 188; 221/2, 221/3, 15; 215/228, 230
See application file for complete search history.

(56) References Cited

U.S. PATENT DOCUMENTS 5,088,056 A 2/1992 McIntosh et al.
5,233,571 A * 8/1993 Wirtschafter ..... 368/10
5,331,953 A 7/1994 Anderson et al.
5,925,021 A 7/1999 Castellano et al.
6,198,383 B1 * 3/2001 Sekura et al. ..... 340/309.4
6,317,390 B1 * 11/2001 Cardoza ..... 368/10
6,324,123 B1 11/2001 Durso
6,545,592 B2 4/2003 Weiner
6,604,650 B2 8/2003 Sagar
6,633,796 B1 * 10/2003 Pool et al. ..... 700/231
6,667,936 B1 * 12/2003 Ditzig ..... 368/10
6,710,703 B2 * 3/2004 Huang ..... 340/309.16
6,817,192 B2 * 11/2004 Ector ..... 62/125
7,054,231 B2 5/2006 Valerio
7,236,428 B1 * 6/2007 Morse ..... 368/10
7,362,660 B2 * 4/2008 Hildebrandt ..... 368/10
2005/0121407 A1 * 6/2005 Hildebrandt ..... 215/228

* cited by examiner

*Primary Examiner* — Vit W Miska
(74) *Attorney, Agent, or Firm* — Arthur L. Lessler

(57) ABSTRACT

A disposable electronic timer in the form of a disk having a liquid crystal or similar display, adapted to be glued to a medication bottle cap. A lower major surface of the timer has an adhesive layer with a cover that can be peeled off to expose the adhesive so that the timer can be secured to the bottle cap. The upper major surface of the timer contains the timer display and a control button that in one mode starts the timer so that an alarm within the timer sounds after a preset time interval, and in another mode sets or resets the timer to a different preset time interval. Operating power is supplied by a battery within the timer.

2 Claims, 2 Drawing Sheets

BOTTLE CAP MEDICATION TIMER

CROSS-REFERENCE TO RELATED APPLICATION

This application claims the benefit of U.S. Provisional Application Ser. No. 60/892,622 filed Mar. 2, 2007 and entitled Bottle Cap Medication Timer.

BACKGROUND OF THE INVENTION

This invention relates to timers for reminding a user of medication to take the same at predetermined time intervals.

Medication timers per se are known in the art, as follows:

U.S. Pat. No. 5,088,056 to McIntosh et al. entitled Medication Clock—Shows a clock with medication-containing compartments. The clock records the time each compartment is opened and provides audio and visual alerts when medication needs to be taken.

U.S. Pat. No. 5,331,953 to Anderson et al. entitled Device in Connection With an Inhaler—Shows an electronic timer in the inhaler which records the time each dosage is taken.

U.S. Pat. No. 5,925,021 to Castellano et al. entitled Medication Delivery Device With a Microprocessor and Characteristic Monitor—Shows an arrangement wherein an inhaler is coupled to an electronic timer to record the time of each dosage taken.

U.S. Pat. No. 6,324,123 to Durso entitled Medication Timer—Shows a bottle cap type timer for providing an alarm when medication is to be taken.

U.S. Pat. No. 6,545,592 to Welner entitled Medication Reminder Device—Shows a pill container cap type timer which generates an alarm when it is time to take a pill.

U.S. Pat. No. 6,604,650 to Sagar entitled Bottle-Cap Medication Reminder and Overdose Safeguard—Shows a "bottle presence sensor" which detects whether medication has been taken, times the interval after that when medication is to be taken again, and generates audio and visual alert signals to inform the user to take the medication again.

U.S. Pat. No. 7,054,231 to Valerio entitled C-Shaped Medication Reminder Device—Shows a C-shaped holder for pill containers, including a switch actuated by a container inserted into the holder, so that the switch starts an integral timer which generates an alarm the next time a pill in the container needs to be taken. The timer is reset by the switch each time the container is removed from the holder and replaced.

An object of the invention is to provide a disposable medication timer which is particularly useful in the dispensing of medication contained in bottles.

SUMMARY OF THE INVENTION

According to the invention a disposable electronic timer having a liquid crystal or similar display has a cylindrical shape with a diameter the same as or smaller than that of a medication bottle cap to which the timer is to be affixed. A lower major surface of the timer has an adhesive layer with a cover that can be peeled off to expose the adhesive so that the timer can be secured to the bottle cap. The upper major surface of the timer comprises the display and a control button that in one mode starts the timer so that an alarm within the timer sounds after a preset time interval; and in another mode sets or resets the timer to a different preset time interval. Operating power is supplied by a battery within the timer.

IN THE DRAWINGS

DETAILED DESCRIPTION

Figure 2:
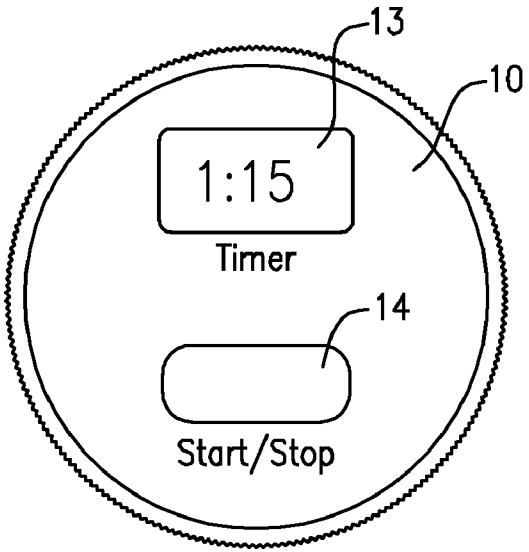
FIG. 2 is a photograph of the timer affixed to the bottle cap shown in FIG. 1.

The disc-shaped timer 10 has an upper major surface 11 and a lower adhesive-coated major surface 12 covered by a layer of paper or plastic which can be peeled off to expose the adhesive. The timer is then pressed against the top of the cap 15 of the medication bottle 16.

Disposed in the upper surface 11 are a display 13 and a control button 14. The display shows time intervals in hours and minutes. A beeper (not shown) within the timer sounds an alarm 20 times when a preset time interval expires.

The timer starts counting when the control button 14 is pressed and not held down, or held down for less than 4 seconds.

The preset time interval can be set or changed by holding the control button 14 down for at least 5 seconds. When the button is first depressed in this manner the preset hourly interval number will display and will begin to increment up one hour at a time. When the desired number displays, releasing the control button sets than number as the new hourly interval.

Figure 1:
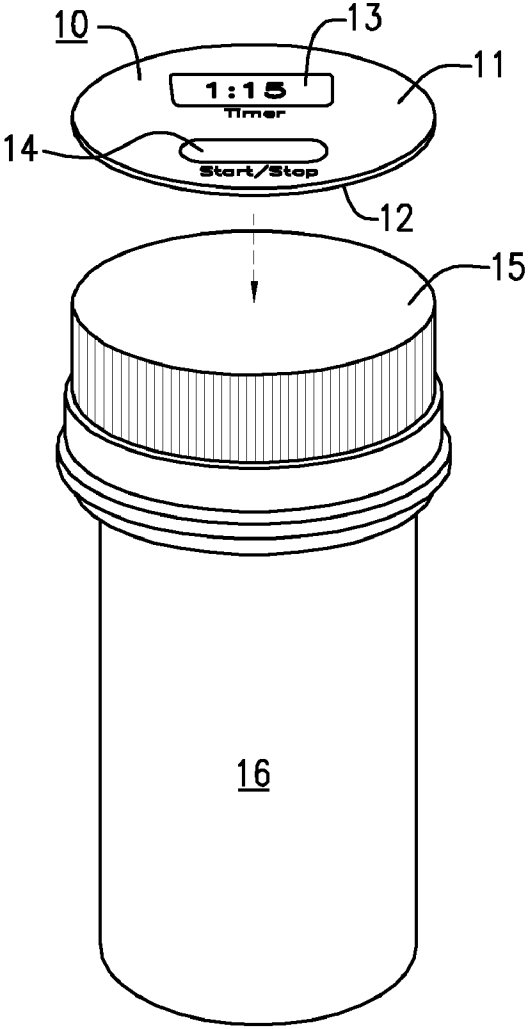
FIG. 1 is a photograph of a bottle cap medication timer according to a preferred embodiment of the invention, adjacent the cap of a medication bottle to which it is to be affixed.
Figure 3A:
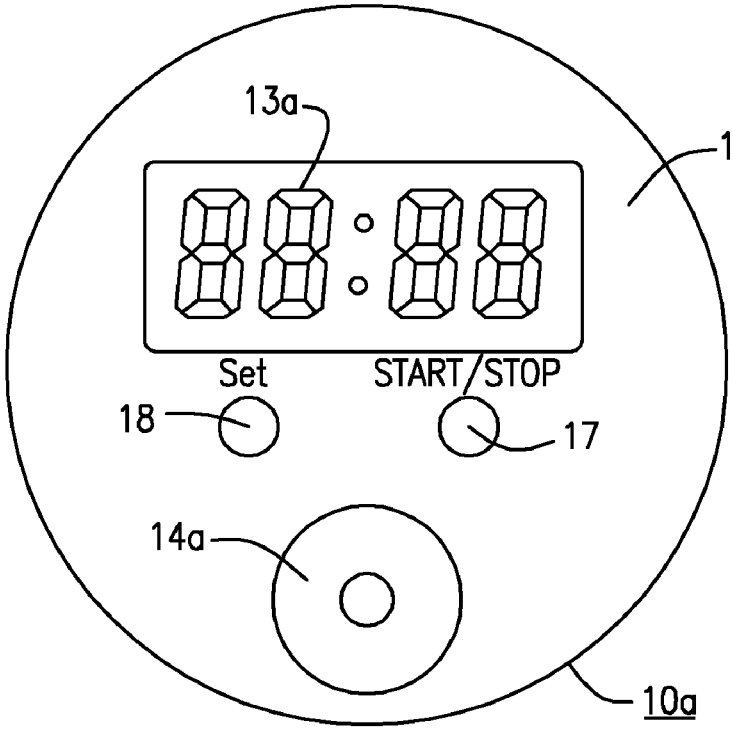
FIG. 3A is a top plan view of the timer according to an alternate embodiment of the invention, drawn to an enlarged scale.
Figure 3B:
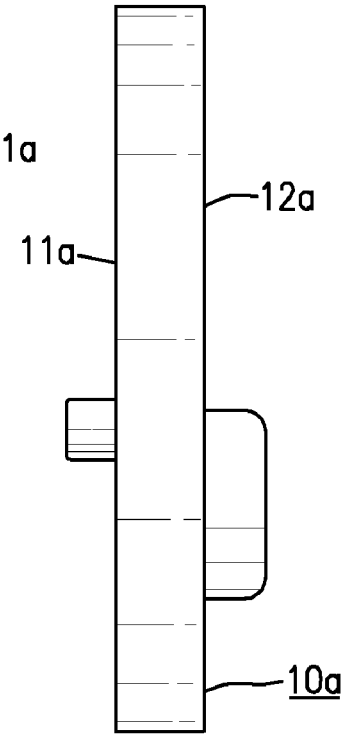
FIG. 3B is a right side elevation view of the timer shown in FIG. 3A.
Figure 4A:
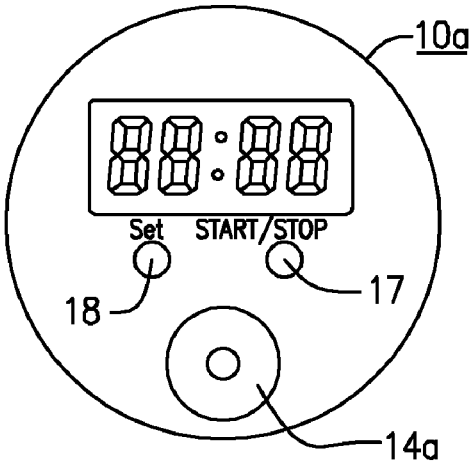
FIG. 4A is a top plan view of the timer shown in FIG. 3A, drawn full scale.
Figure 4B:
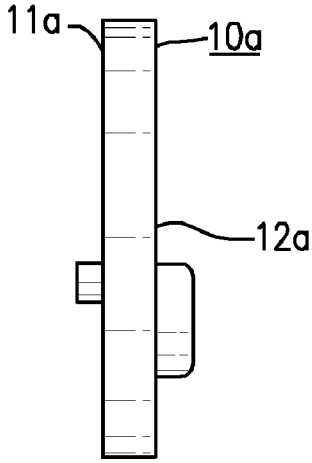
FIG. 4B is a right side elevation view of the timer shown in FIG. 3B, drawn full scale.

In the alternate embodiment shown in FIGS. 3A-4B similar parts to those of FIGS. 1 and 2 are given the same identifying numerals followed by the letter "a".

The alternate embodiment has two additional control buttons, namely a start-stop button and a reset button 18. The button 14*a* operates in the same manner as the button 14 operates.

The start-stop and reset buttons 17 and 18 are used to (independently of the button 14) operate the timer in a stopwatch mode, with the time elapsed from the last time the start-stop button was used to start the timer being continuously displayed.

I claim:

1. A disposable variable interval electronic timer for facilitating the dosing of medication comprising:

a disk adapted to be affixed to a medication bottle cap, said disk having upper and lower major surfaces and comprising a timer having (i) a timer circuit, (ii) a timer display adjacent the upper major surface of the disk, and (iii) means for supplying electrical power to said circuit and display;

an adhesive layer on the lower major surface of the disk, said layer having a cover that can be peeled off to expose the adhesive layer so that the timer can be secured to the bottle cap; and a control button operatively associated with said circuit that (i) in a start-stop mode starts the timer when the control button is pressed for less than a first predetermined number of seconds so that an alarm within the timer sounds after a preset time interval, and (ii) in an interval setting mode sets the timer to a different preset time interval when the control button is pressed for at least a second predetermined number of seconds to cause a preset hourly interval number to display and begin to increment up one hour at a time, held until the desired preset time interval is displayed, and then released to set the number then displayed as the new hourly interval.

2. The timer according to claim 1, wherein said disk includes start-stop and reset buttons for operating the timer in a stopwatch mode, with the time elapsed from the last time the start-stop button was used to start the timer being continuously displayed.

* * * * *